US012257486B1

(12) United States Patent
Myrhum

(10) Patent No.: US 12,257,486 B1
(45) Date of Patent: Mar. 25, 2025

(54) PICKLEBALL PADDLE

(71) Applicant: Ogio International, Inc., Carlsbad, CA (US)

(72) Inventor: Mark Myrhum, San Diego, CA (US)

(73) Assignee: Topgolf Callaway Brands Corp., Carlsbad, CA (US)

( * ) Notice: Subject to any disclaimer, the term of this patent is extended or adjusted under 35 U.S.C. 154(b) by 0 days.

(21) Appl. No.: 18/810,359

(22) Filed: Aug. 20, 2024

Related U.S. Application Data

(60) Provisional application No. 63/621,688, filed on Jan. 17, 2024, provisional application No. 63/534,776, filed on Aug. 25, 2023.

(51) Int. Cl.
*A63B 59/42* (2015.01)
*A63B 60/24* (2015.01)
*A63B 102/08* (2015.01)

(52) U.S. Cl.
CPC ..... *A63B 59/42* (2015.10); *A63B 60/24* (2015.10); *A63B 2102/08* (2015.10); *A63B 2209/02* (2013.01)

(58) Field of Classification Search
CPC ..... A63B 59/42; A63B 60/02; A63B 60/04; A63B 60/24; A63B 2120/08
USPC ..... 473/527
See application file for complete search history.

(56) References Cited

U.S. PATENT DOCUMENTS

| | | | | | |
|---|---|---|---|---|---|
| 3,913,911 | A * | 10/1975 | Peterson | A63B 60/02 | 473/519 |
| 4,693,474 | A * | 9/1987 | Glaessgen | A63B 60/02 | 473/519 |
| RE33,372 | E * | 10/1990 | Frolow | A63B 49/022 | 473/523 |
| 5,058,902 | A * | 10/1991 | McCutchen | A63B 60/32 | 473/552 |
| D620,061 | S | 7/2010 | Morrison | | |
| 8,282,514 | B2 * | 10/2012 | Kapheim | A63B 49/12 | 473/549 |
| 8,715,117 | B1 | 5/2014 | Janish | | |
| 8,968,125 | B2 * | 3/2015 | Schwenger | A63B 60/02 | 473/537 |
| D765,196 | S | 8/2016 | Bonfigli | | |
| 9,533,198 | B2 * | 1/2017 | Yamamoto | A63B 60/42 | |
| D846,674 | S | 4/2019 | Yan | | |
| D847,283 | S | 4/2019 | Yan | | |
| D910,787 | S | 2/2021 | Gong | | |
| D910,788 | S | 2/2021 | Gong | | |
| D918,320 | S | 5/2021 | Torres Porrata et al. | | |
| D938,530 | S | 12/2021 | Gong | | |
| 11,376,483 | B1 | 7/2022 | Prewitt | | |
| D980,930 | S | 3/2023 | Kirkconnell | | |
| 11,597,169 | B2 | 3/2023 | Simmons | | |
| 11,612,792 | B2 | 3/2023 | Marshall | | |
| D994,059 | S | 8/2023 | Jin | | |
| D995,672 | S | 8/2023 | Atkins | | |
| 2002/0160866 | A1 * | 10/2002 | Matsuoka | A63B 60/02 | 473/519 |
| 2004/0248677 | A1 * | 12/2004 | Vu | A63B 49/00 | 473/519 |

(Continued)

*Primary Examiner* — Joseph B Baldori
(74) *Attorney, Agent, or Firm* — Michael A. Catania

(57) ABSTRACT

A pickleball paddle is disclosed herein. The pickleball paddle includes a body with a face section and a handle section. The face section has a perimeter. A grip is attached to the handle section. Weighting is positioned in the perimeter of the face section.

9 Claims, 14 Drawing Sheets

(56) References Cited

U.S. PATENT DOCUMENTS

| | | | | |
|---|---|---|---|---|
| 2012/0289366 | A1* | 11/2012 | Kimmelman | A63B 60/02 473/519 |
| 2014/0066235 | A1 | 3/2014 | Hill et al. | |
| 2016/0107053 | A1 | 4/2016 | Pree | |
| 2016/0250533 | A1 | 9/2016 | O'Rourke | |
| 2017/0021247 | A1 | 1/2017 | Marvin | |
| 2017/0021248 | A1 | 1/2017 | Marvin | |
| 2017/0136325 | A1 | 5/2017 | Fox et al. | |
| 2018/0104555 | A1 | 4/2018 | Taylor | |
| 2018/0304132 | A1 | 10/2018 | Epp | |
| 2019/0224538 | A1* | 7/2019 | Spackman | A63B 53/0466 |
| 2020/0360778 | A1 | 11/2020 | Lee | |
| 2020/0398130 | A1 | 12/2020 | Lee | |
| 2021/0252356 | A1 | 8/2021 | Thurman et al. | |
| 2021/0252357 | A1 | 8/2021 | Lee | |
| 2021/0260452 | A1 | 8/2021 | Zheng | |
| 2022/0032141 | A1 | 2/2022 | Brents et al. | |
| 2022/0040937 | A1* | 2/2022 | Simmons | B29C 70/68 |
| 2022/0088449 | A1* | 3/2022 | Marshall | A63B 59/42 |
| 2022/0126180 | A1 | 4/2022 | Phelan, Jr. et al. | |
| 2022/0266106 | A1 | 8/2022 | Nygren | |
| 2022/0273997 | A1 | 9/2022 | Zheng | |
| 2022/0347541 | A1 | 11/2022 | Gebert | |
| 2023/0021178 | A1 | 1/2023 | Montes et al. | |
| 2023/0030014 | A1 | 2/2023 | Turner et al. | |
| 2023/0047371 | A1 | 2/2023 | Lee | |
| 2023/0149784 | A1 | 5/2023 | Lee | |
| 2023/0191215 | A1 | 6/2023 | Barnes et al. | |
| 2023/0249042 | A1 | 8/2023 | Barnes et al. | |
| 2023/0264083 | A1 | 8/2023 | Frankel | |
| 2023/0293961 | A1* | 9/2023 | Haut | A63B 59/42 473/527 |
| 2023/0356048 | A1* | 11/2023 | Junkins | A63B 59/42 |
| 2024/0058656 | A1* | 2/2024 | Lammer | A63B 49/02 |
| 2024/0207706 | A1* | 6/2024 | Navarrete | A63B 69/00 |
| 2024/0286014 | A1* | 8/2024 | Marks | A63B 60/42 |

* cited by examiner

PICKLEBALL PADDLE

CROSS REFERENCES TO RELATED APPLICATIONS

The Present Application claims priority to U.S. Provisional Patent Application No. 63/534,776, filed on Aug. 25, 2023, and to U.S. Provisional Patent Application No. 63/621,688, filed on Jan. 17, 2024, each of which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to a sports paddle. More specifically, the present invention relates to a pickleball paddle.

Description of the Related Art

Pickleball paddle construction, in its latest generation of the booming sport, in the premium space, is mostly made-up boutique brands with composite-type constructions. Generally, the paddle construction is the same across many premium paddles with a core made out of plastic honeycomb design, such as polypropylene or similar. Faces of the paddles are constructed of composite (thermoset resin systems) layups with fibers (i.e., T700 Toray, etc.) glued all together. Trim border called "edge guard" is applied after bonding faces to the core with bonding, and grip stock applied, grip tape, grip butt cap bonded. Core and faces are 1 continuous piece in the premium brands. Not a handle+ paddle head added. This gives far more durability for tournament serious players with high 'swing' speeds/ball speed.

The key to the sport is the control of spin, to move the paddle ball directionally through the air. This is the key in competition to keep the ball where your opponent cannot reach it in time to make a return play on the ball. The USA Pickleball (USAP) association has paddle restrictions that have become complex over the recent 2 years due to the unregulated sport, surface roughness on the paddle that's hard to measure, the core breaking down, and ball speed jumping up to really fast speeds, making spring or spring-like material or flexible/compliant materials illegal. Think United States Golf Association (USGA) regulations now, especially at tournaments.

BRIEF SUMMARY OF THE INVENTION

The present invention incorporates new materials, more durability, and better ball speed in the paddle design. Additionally, it incorporates a player adjustable weighting feature in the perimeter of the paddle and butt cap for optimum performance (ball speed, spin control).

The pickleball paddle of the present invention has a high MOI, approximately 7000 g-cm$^2$.

Materials such as thermoforged composites (TFC) are used for the face and handle panels.

Weighting in the paddle perimeter allows for more ball speed due to mass, and changes player hand speed with the handle weighting.

The pickleball paddle has higher performance, durability, and adjustable weighting.

One aspect of the present invention is a pickleball paddle comprising a body, a grip and weighting members. The body comprises a face section and a handle section. The face section has a perimeter. A grip is attached to the handle section. A first weighting member is positioned in the perimeter of the face section and a second weighting member positioned in the perimeter of the face section. The pickleball paddle has a moment of inertia greater than 6700 g-cm$^2$.

Another aspect of the present invention is a pickleball paddle comprising a body, a grip and weighting members. The body comprises a face section and a handle section. The face section has a perimeter. A grip is attached to the handle section. A first weighting member is positioned in the perimeter of the face section on a first side, a second weighting member is positioned in the perimeter of the face section on the first side, a third weighting member is positioned in the perimeter of the face section on a second side, and a fourth weighting member is positioned in the perimeter of the face section on the second side. The pickleball paddle has a moment of inertia greater than 7000 g-cm$^2$.

Each of the first weight member, the second weight member, the third weight member and the fourth weight member preferably has a mass ranging from 2 to 5 grams. Each weight member is preferably composed of tungsten, tungsten alloy, iron or iron alloy.

The pickleball paddle preferably has a length ranging from 15 to 17 inches and a width ranging from 7 inches to 8 inches.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1A:
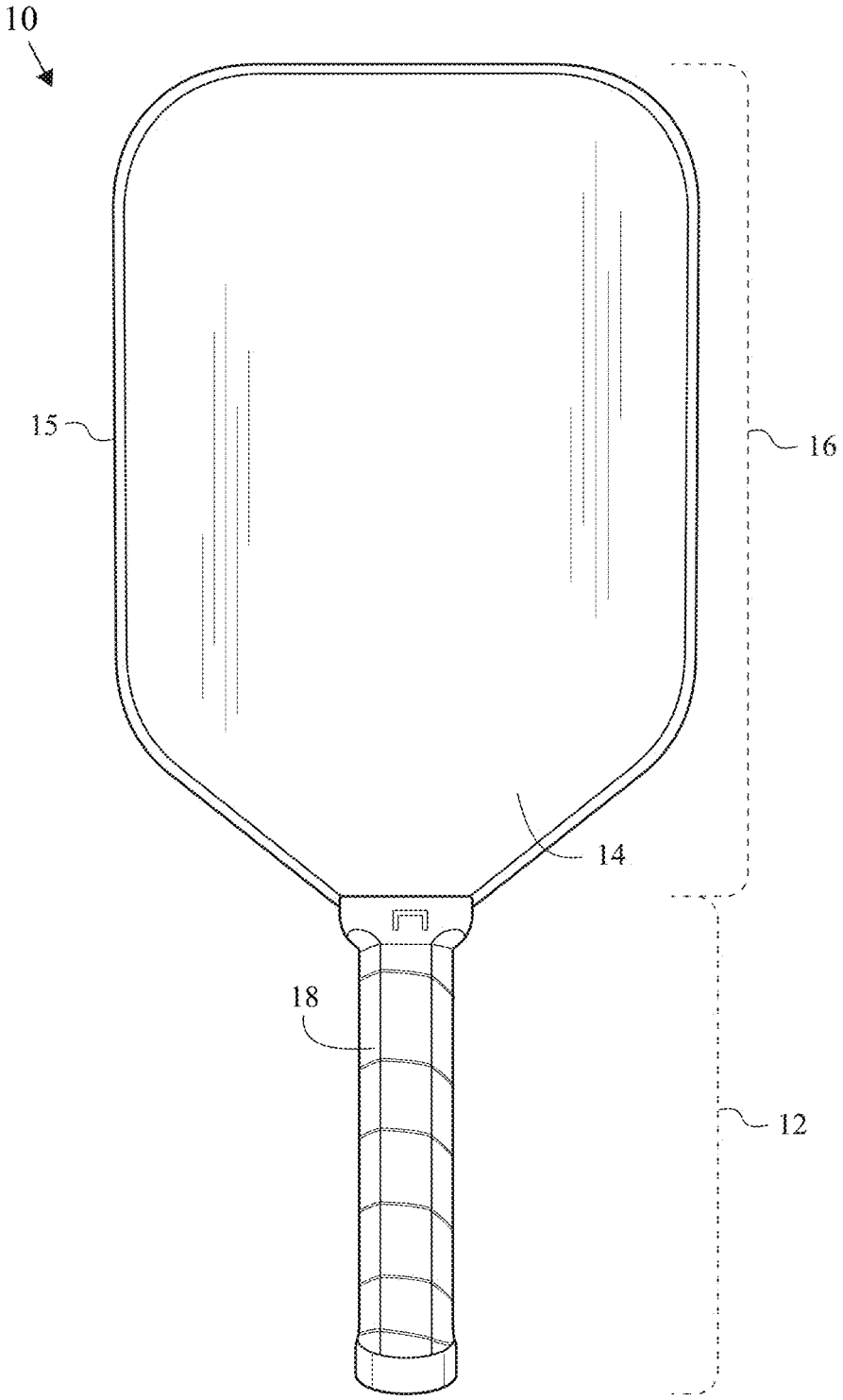
FIG. 1A is an illustration of a pickleball paddle.
Figure 1B:
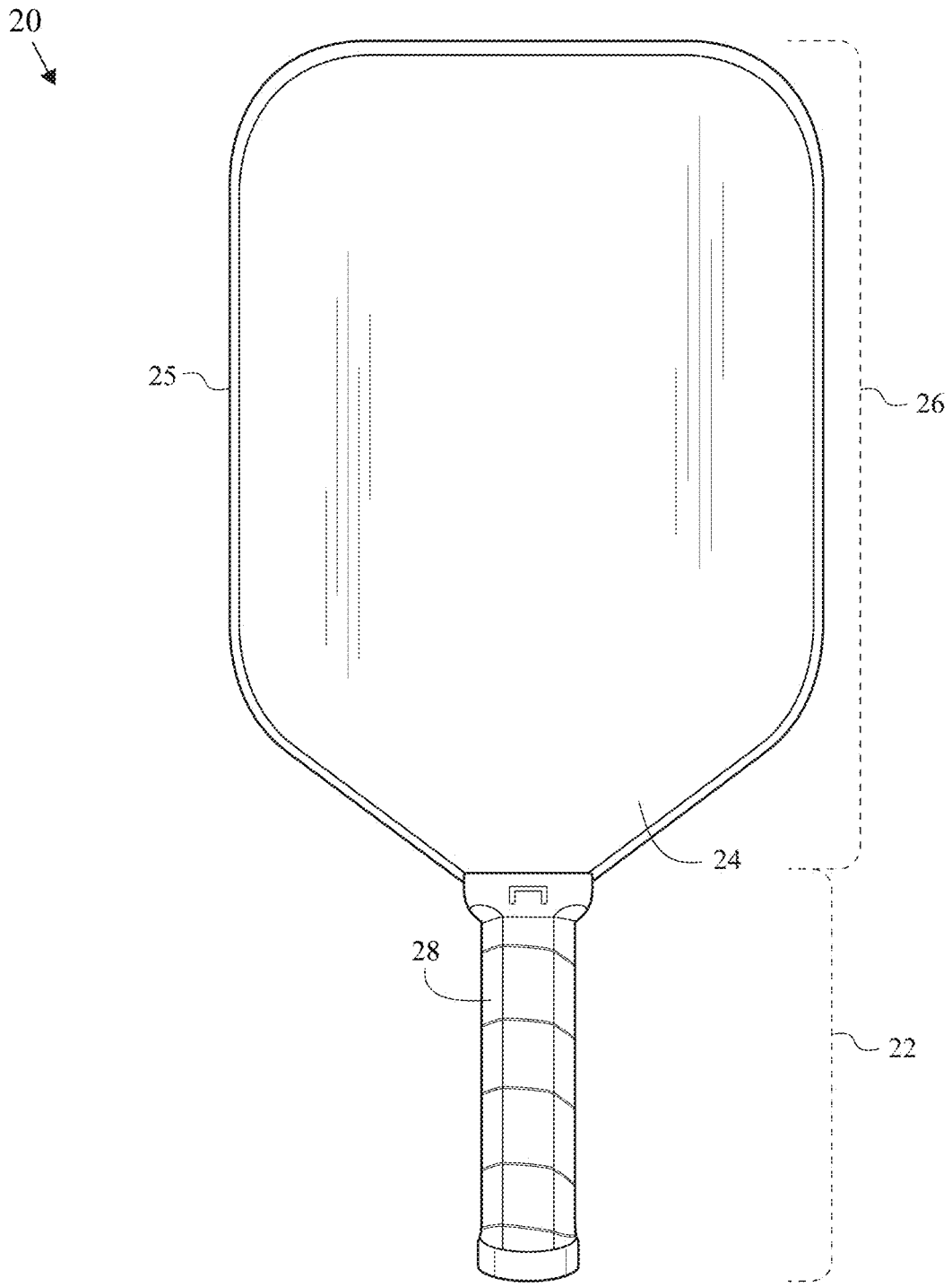
FIG. 1B is an illustration of another embodiment of a pickleball paddle.
Figure 2:
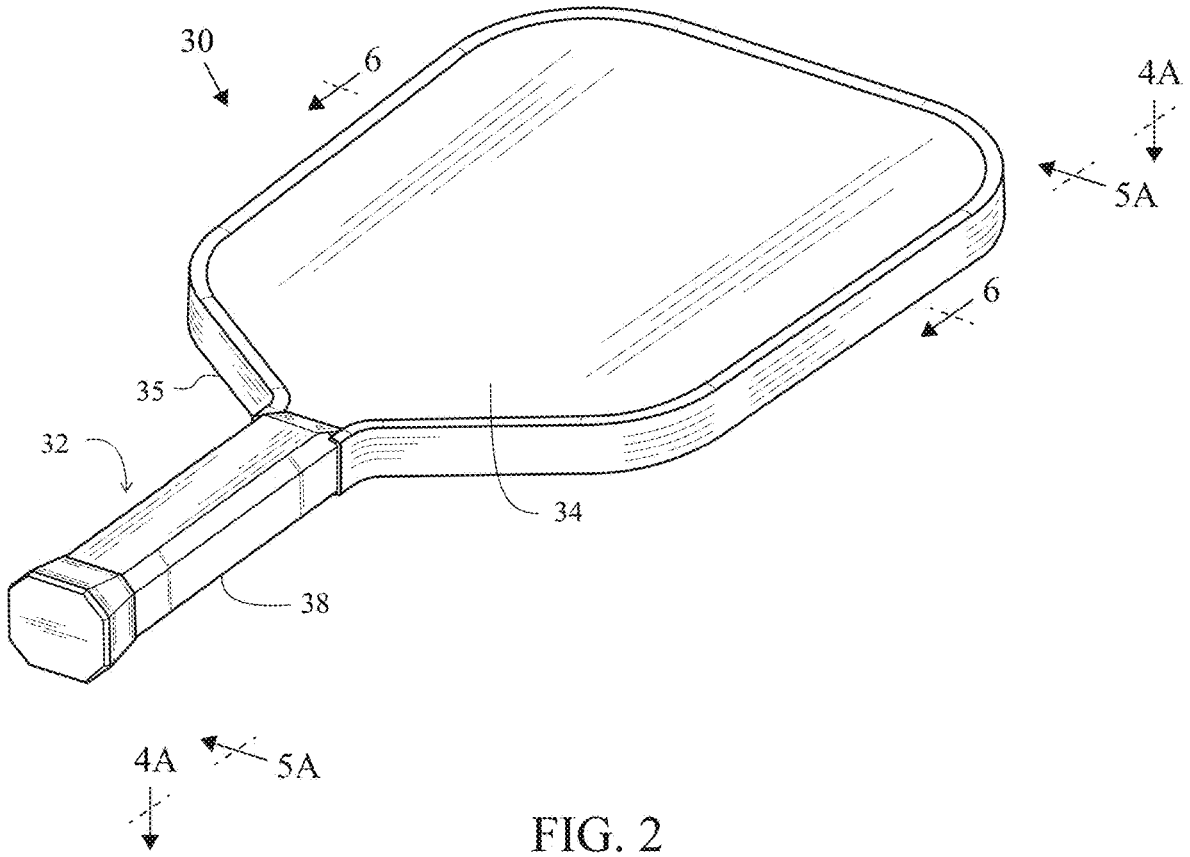
FIG. 2 is a top perspective view of another embodiment of a pickleball paddle.
Figure 3:
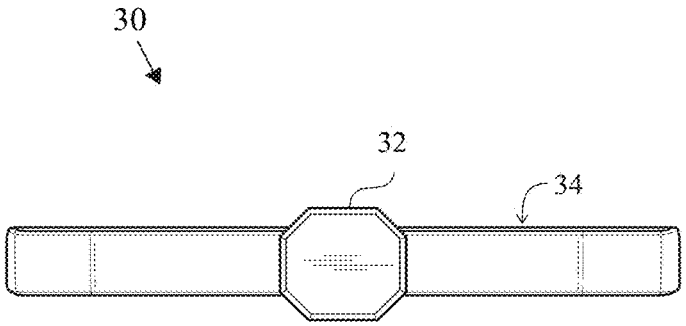
FIG. 3 is a bottom elevation view of a pickleball paddle.
Figure 4A:
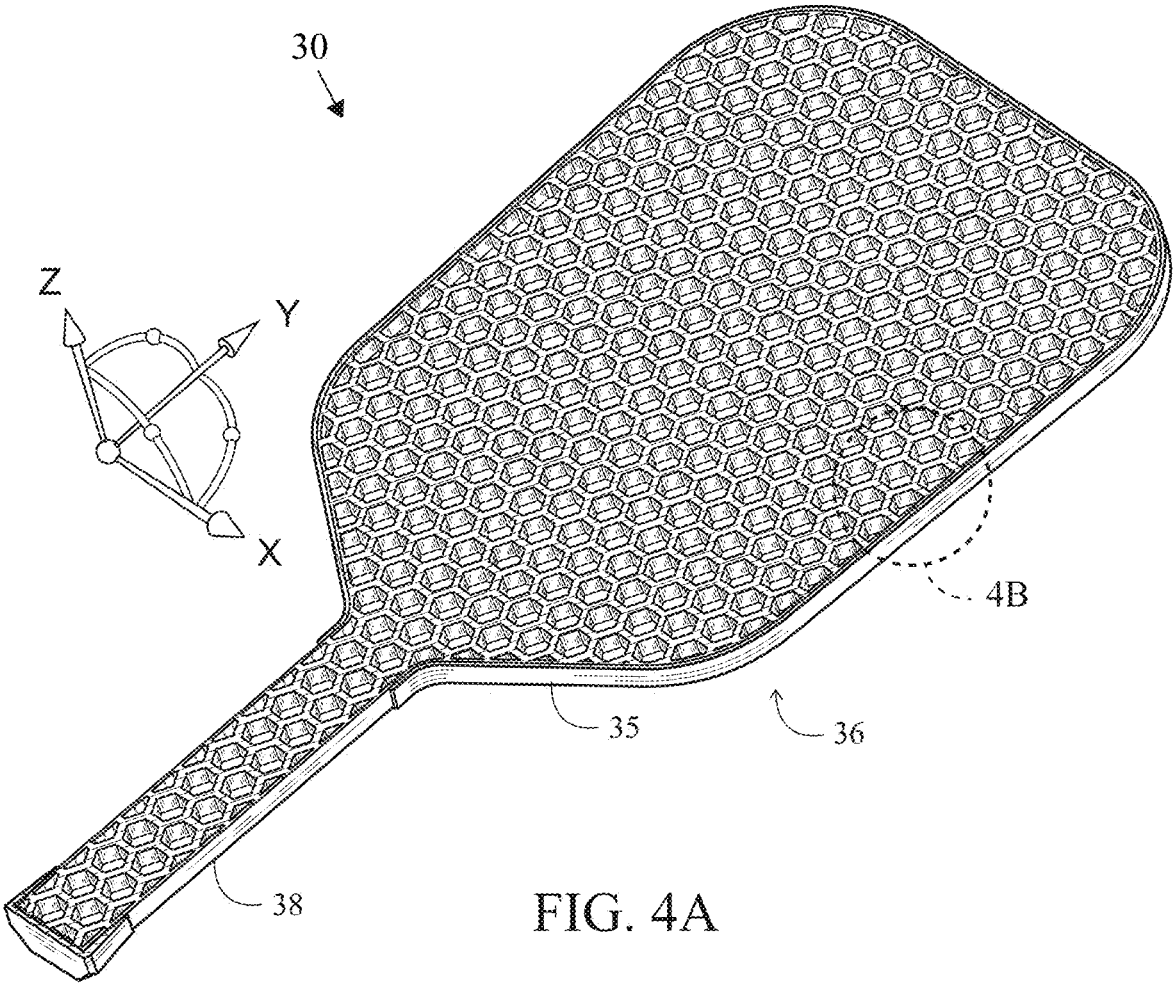
FIG. 4A is a top perspective cross-sectional view of an interior of a pickleball paddle.
Figure 4B:
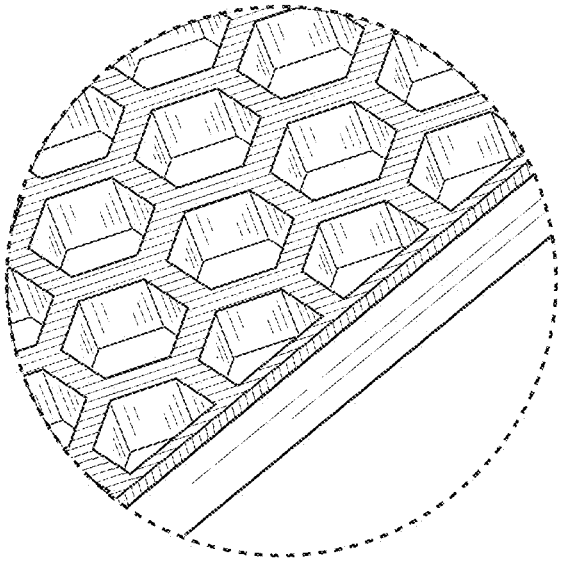
FIG. 4B is a detailed section of the pickleball paddle of FIG. 4A.
Figure 5A:
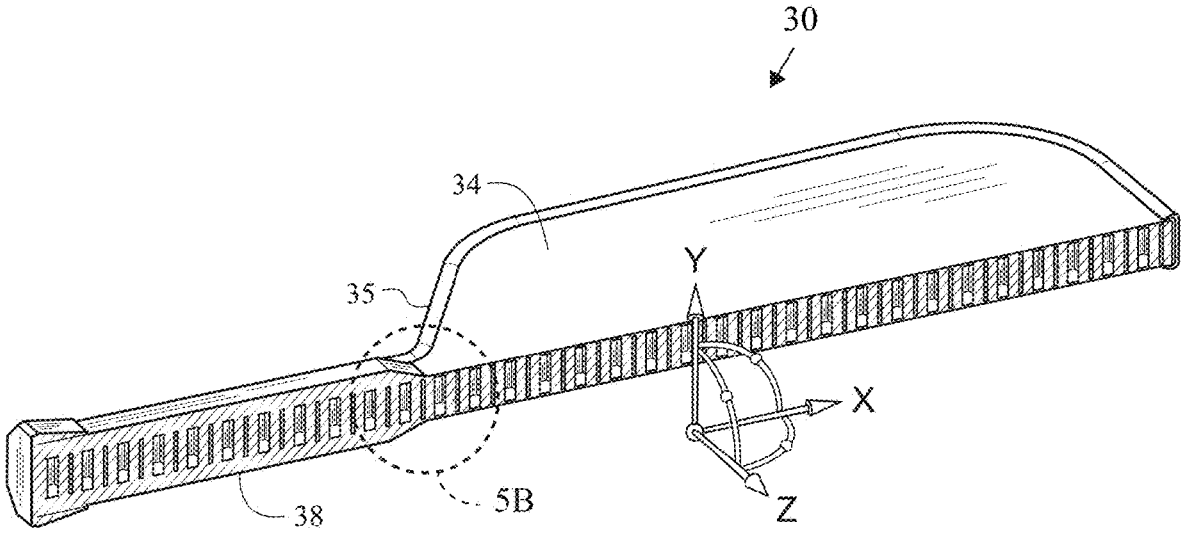
FIG. 5A is a top perspective cross-sectional view of a pickleball paddle.
Figure 5B:
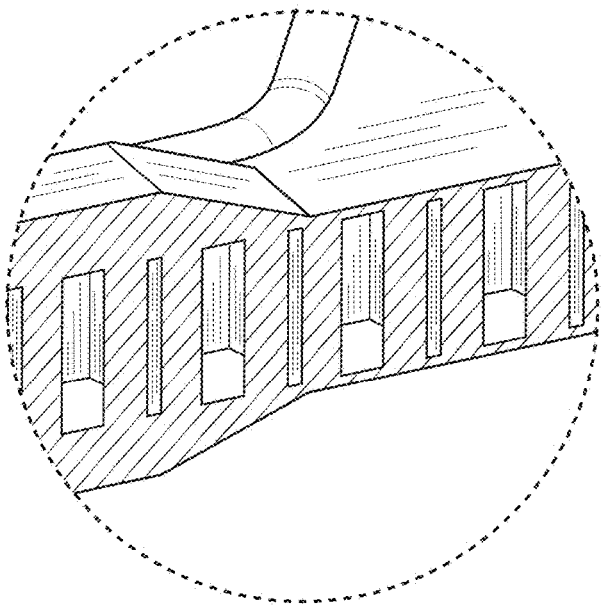
FIG. 5B is a detailed section of the pickleball paddle of FIG. 5A.
Figure 6:
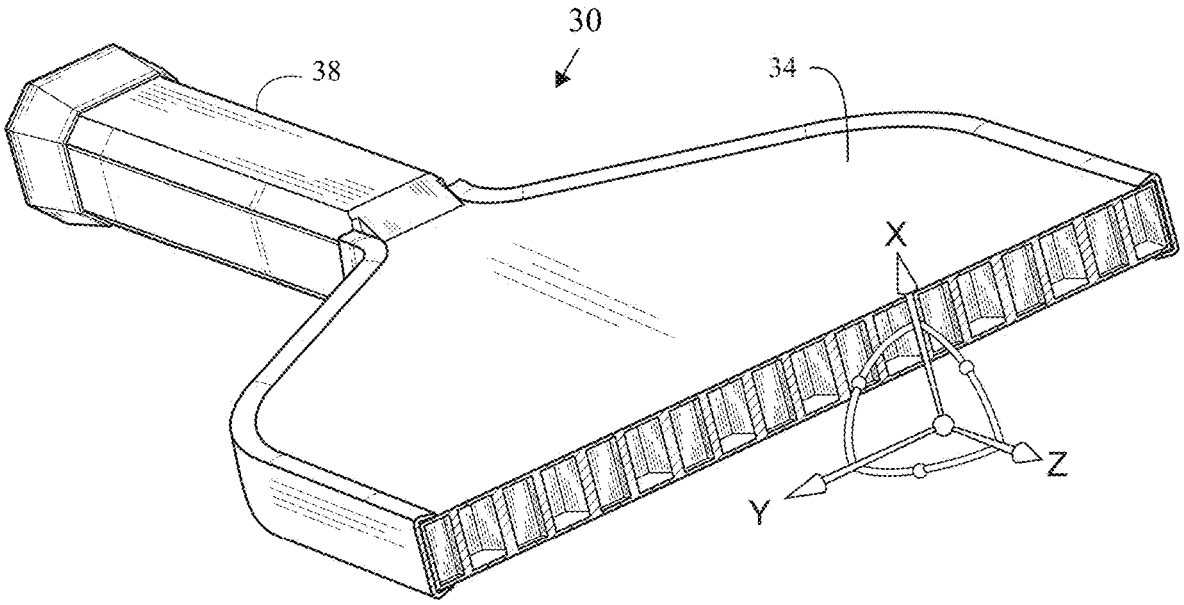
FIG. 6 is a top perspective cross-sectional view of a pickleball paddle.
Figure 7:
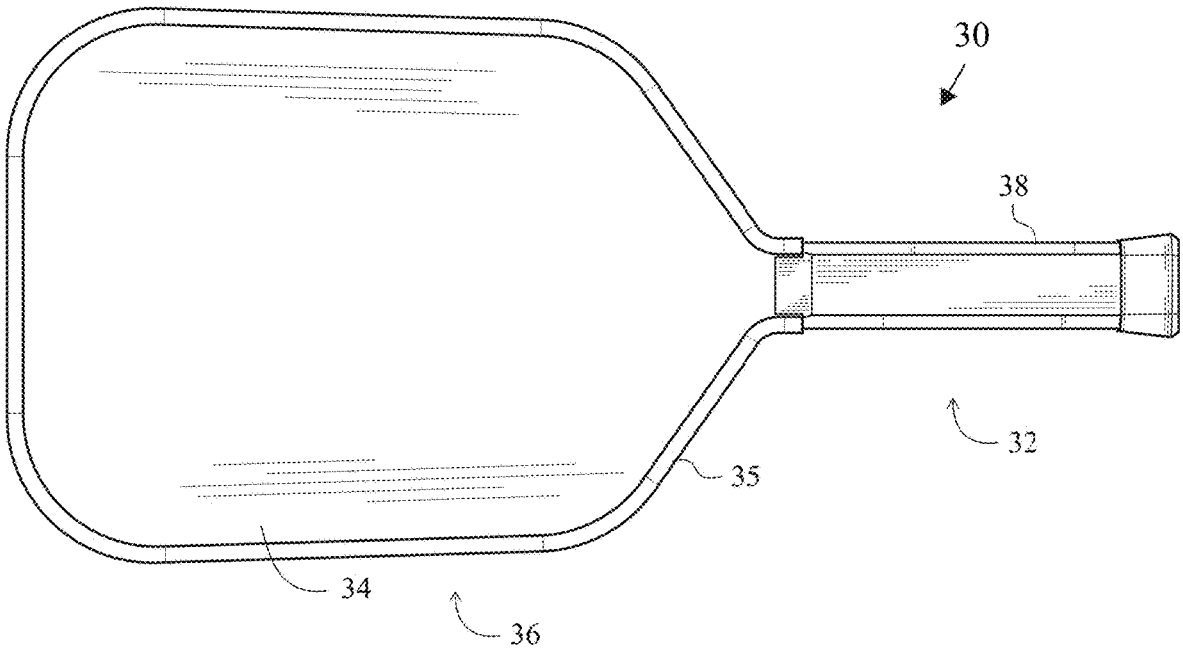
FIG. 7 is a top plan view of a pickleball paddle.

FIGS. 1A and 1B are an illustration of two pickleball paddle embodiments. Their target weight and grip size are the same. The differences in the paddle profiles target specific performances.

The pickleball paddle 10 of FIG. 1A has a longer face 14 and a longer handle 12 for unrivaled balance of reach, power, and control. The target specifications are the following: a target weight of 8 ounces, a grip 18 size of 4.25 inches, a grip length of 5.5 inches, a paddle 16 length of 16.3 inches, a paddle 16 width of 7.575 inches (with a slight taper from 7.2-7.6 inches), and a core thickness ranging from 14 mm to 16 mm.

The pickleball paddle 20 of FIG. 1B has a wider face 24 and a shorter handle 22 providing a larger sweet spot for ultimate consistency. The target specifications are the following: a target weight of 8 ounces, a grip 28 size of 4.25 inches, a grip length of 4.75 inches, a paddle 26 length of 16 inches, a paddle 26 width of 8 inches, and a core thickness of 16 mm.

FIGS. 2-7 illustrate yet another embodiment of a pickleball paddle 30. FIGS. 4A-6 show cross sectionals of the paddle 30. A pickleball paddle 30 comprises of a body, which includes a face 34 having a perimeter 35 and a handle 32, a grip 38 attached to the handle 32.

FIGS. 8-11 show different embodiments of a pickleball paddle 40, 50 with perimeter weighting 70, 80, respectively. The paddle 40 includes a face 44 having a perimeter 45 and a handle 42 with a grip 48 and a weighting 70*a-b* positioned in the perimeter 45. In a preferred embodiment, the paddle 50 comprises a body which includes a face 54 having a perimeter 55 and a handle 52, a grip 58 attached to the handle 52, and a weighting 80*a-b* positioned in the perimeter 55 of the face 54.

Figure 12:
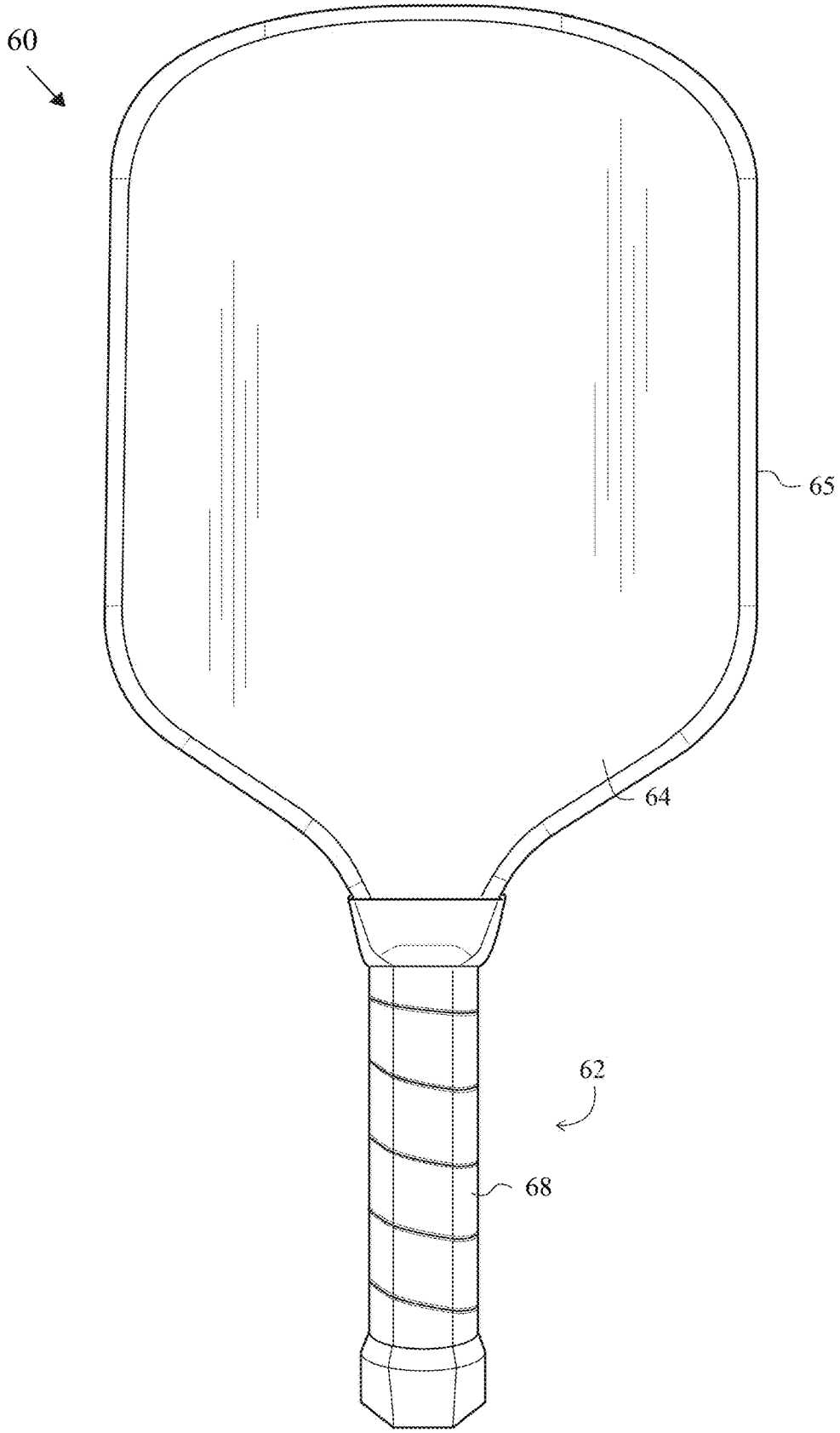
FIG. 12 is an illustration of another embodiment of a pickleball paddle.
Figure 13:
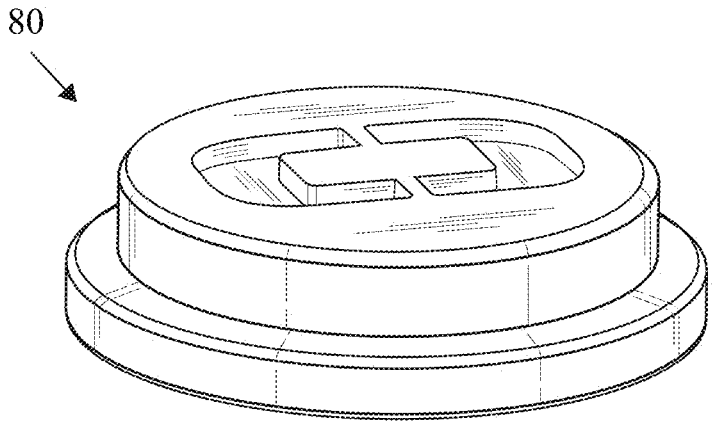
FIG. 13 is an illustration of a tungsten weight of a pickleball paddle.

FIG. 12 is another embodiment of a pickleball paddle 60 with a face 64 having a perimeter 65 and a handle 62 with a grip 68.

Preferably, the handle 32 section comprises a weighting feature. Alternatively, or additionally, the butt cap of the handle 32 includes a weighting feature.

Materials such as PEI and PES with carbon fiber reinforcement such as T700 Toray or M30 Mitsubishi is preferably used to make the laminate layups of [0/90/+45/−45] type, traditionally used in golf, automotive, and aerospace. Adding materials to the surface outside or inside layers can create better stiffness, strength, and toughness. Plain Weave materials and designs can be incorporated for cosmetic enhancements without degrading the performance.

Perimeter weighting can be on the top, sides, and yoke. Combinations of weight ports for weights ranging from 2 g to 50 g, with preference on increments of 4-5 g. The perimeter weighting is preferably more than one weight, more preferably 2-20 weights, and even more preferably 4-10 weights.

Handle or butt cap weights increase a player's feel/balance, "swing weighting", and also are an opportunity for performance upgrades (ball speed and spin control) through better fitting.

Weighting Ports (individual weight set locations) or preferably a slider track (multiple weights and locations) on the edge guard allow for moving the weighting of the paddle, and changing the center of gravity (CG) from the handle to the top of the paddle end.

The preferred embodiment of the paddle has the following: length: 16.3 inches; width: 7.6 in./7.3 in. (with a simulated edge guard); length+width: 23.9 inches (USAP Rule: combined length and width, including any edge guard and butt cap, not to exceed 24 inches); handle length: 5.5 inches; handle circumference: 4.125 in.; and core Thickness: 14 mm-16 mm.

Figure 10:
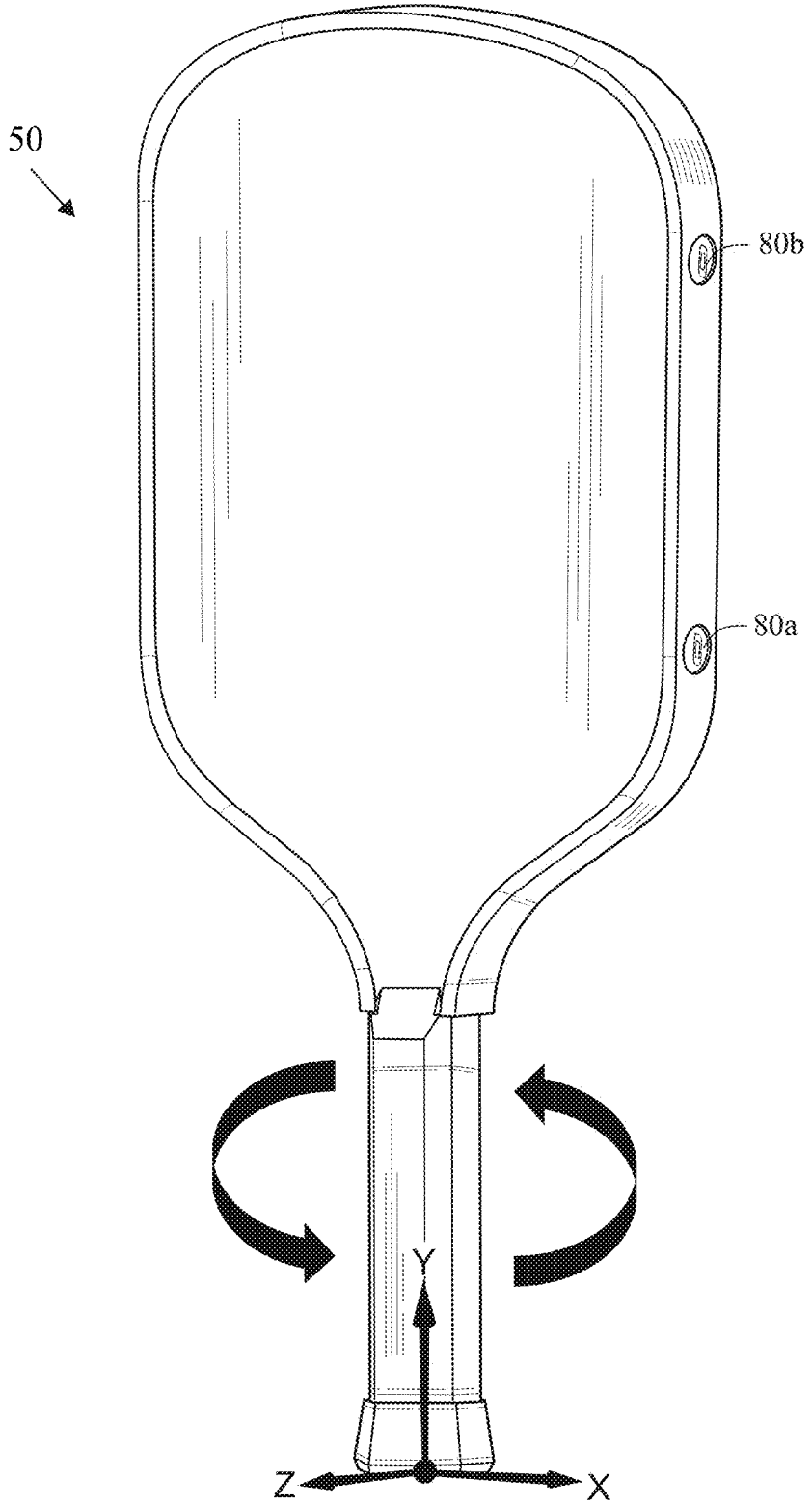
FIG. 10 is an illustration of a pickleball paddle showing twist weight moment of inertia.

Twist Weight, as shown in FIG. 10, is the moment of inertia (MOI) about the centerline of the handle/grip thru paddle face.

Figure 11:
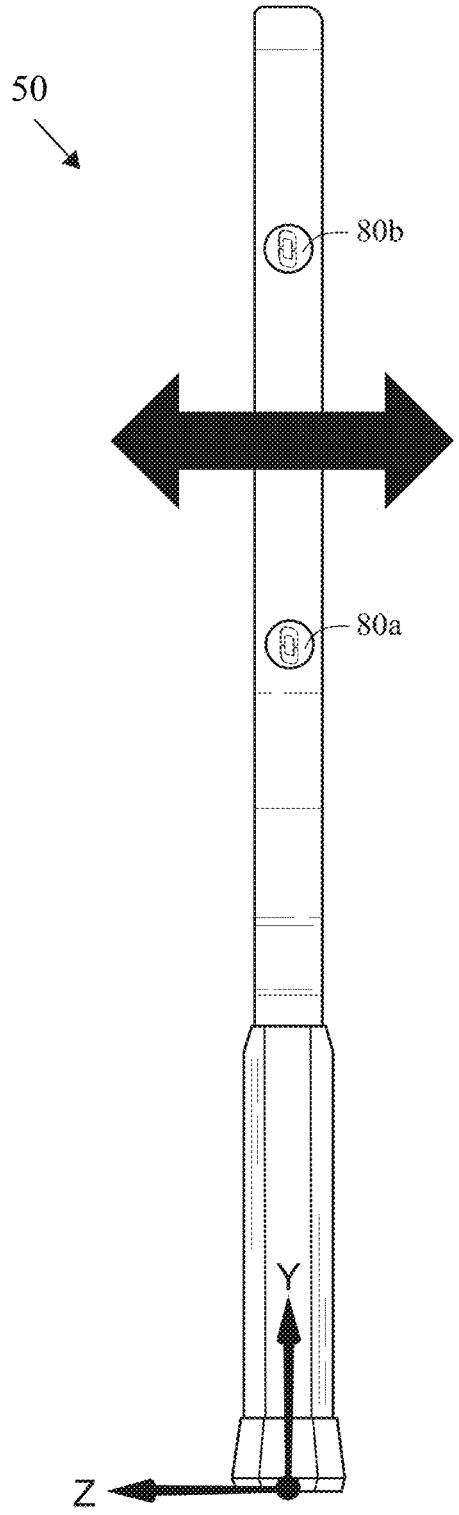
FIG. 11 is an illustration of a pickleball paddle showing swing weight moment of inertia.

Swing Weight, as shown in FIG. 11, is the MOI above the end of the handle/grip. There is no fulcrum in this measurement and is the actual weight×distance squared (unlike an algorithmic scale).

Figure 14:
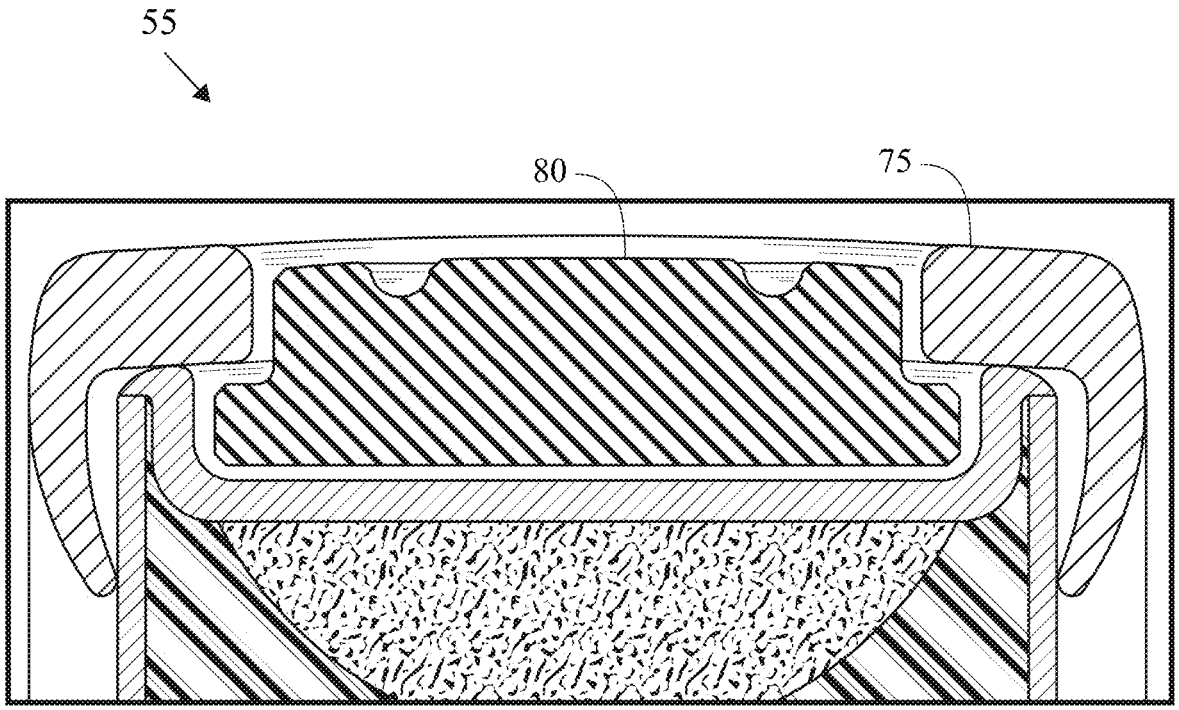
FIG. 14 is a cross-sectional view of a tungsten weight within a pickleball paddle.
Figure 16:
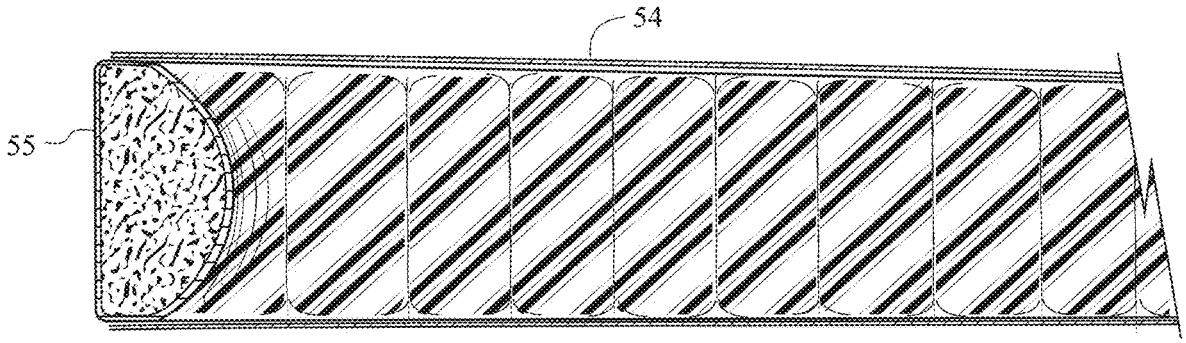
FIG. 16 is a cross-sectional view of the perimeter of the face frame.

The pickleball paddle preferably has tungsten infused weighting, 3-5 grams each, that are molded and added to the perimeter 55 inside the edge guard 75, as shown in the cross-section of FIG. 14. FIG. 16 is a cross-sectional view of the perimeter 55 of the face 54 frame.

Figure 8:
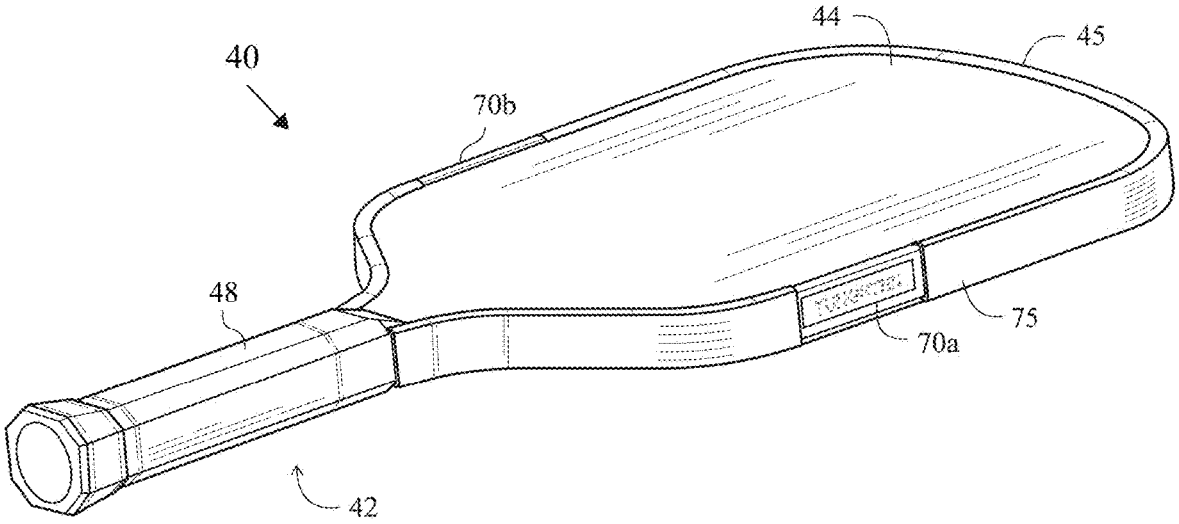
FIG. 8 is an illustration of a pickleball paddle with perimeter weighting.
Figure 9:
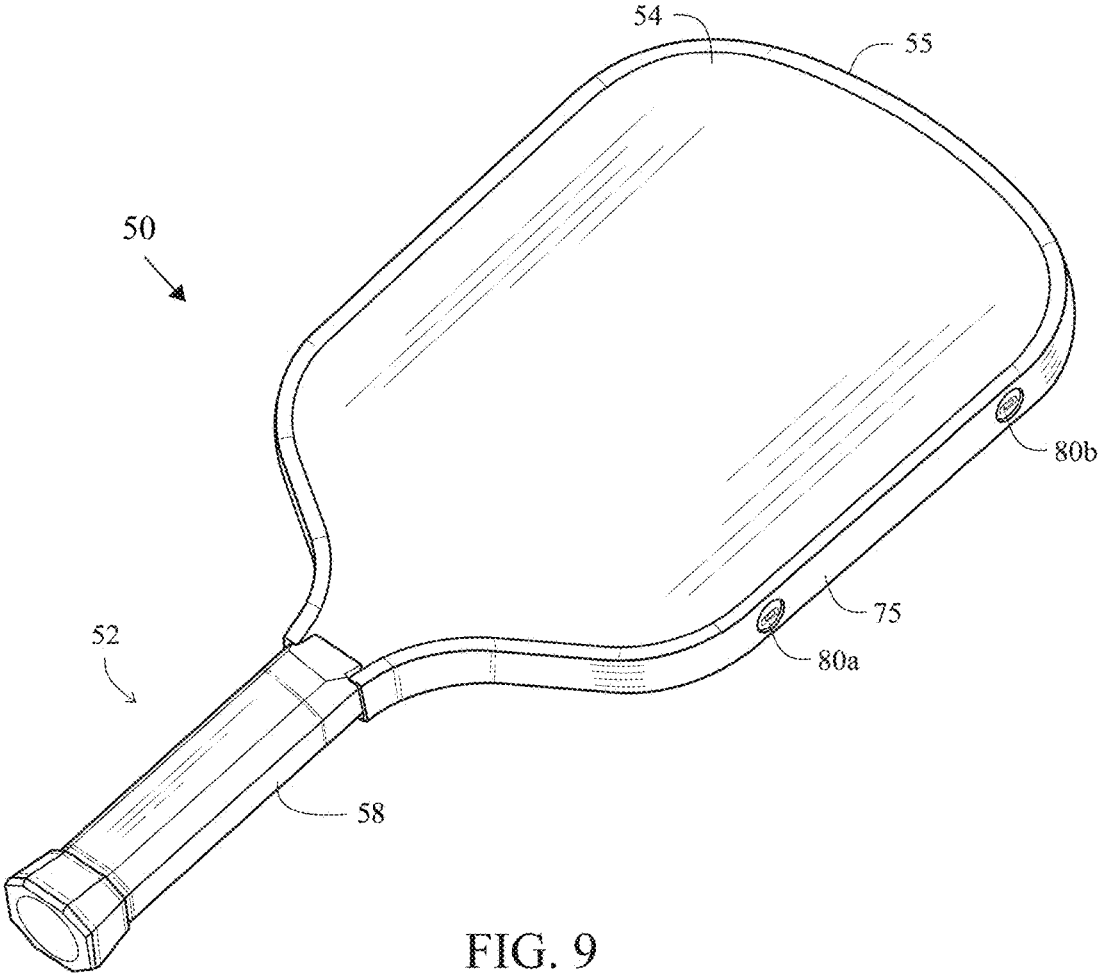
FIG. 9 is an illustration of a pickleball paddle with another embodiment of perimeter weighting.
Figure 15:
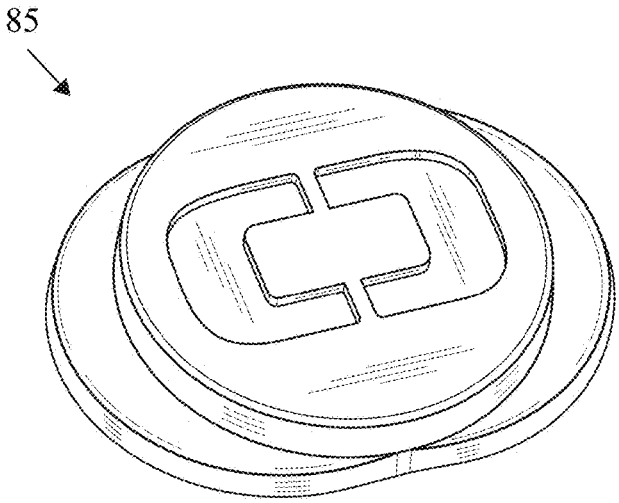
FIG. 15 is an illustration of another embodiment of a tungsten weight of a pickleball paddle.

FIG. 8 illustrates one embodiment of the weight 70*a*-70*b*. FIGS. 9-11 and FIG. 13 illustrate another embodiment of the weight 80. FIG. 15 illustrates yet another embodiment of the weight 85. An alternative to the tungsten powder is steel=0.01 cm thick×1.2 cm×4 cm (0.040 inch×0.47 inch×1.57 inches)=3.7 g, similar to a nickel flat medallion at and it can have a company logo on it for marketing.

Another embodiment is the use of a "CLEAR" Edge guard in the perimeter weighting locations so that the weighting is visible to the user. An alternative is PVD or other colors for marketing.

Table One illustrates mass properties of commercially available pickleball paddles. All of the competitor commercially available paddles have a twist weight MOI below 6620 g*cm$^2$. Most have twist weight MOIs below 6330 g*cm$^2$.

TABLE ONE

| Make | Length (inches) | Width (inches) | Thickness (mm) | Weight (grams) | Swing Weight MOI (Kg * cm^2) | Twist Weight MOI (Kg * cm^2) |
|---|---|---|---|---|---|---|
| CRBN Power Series 1X 16 mm | 16.53 | 7.44 | 15.6 | 229.4 | 123 | 6.30 |
| JOOLA Perseus 16 mm | 16.43 | 7.39 | 16 | 222.2 | 117 | 5.85 |
| LEGACY 16 mm | 16.55 | 7.57 | 15.5 | 229.1 | 120 | 6.62 |
| RONBUS R1 Pulsar | 16.42 | 7.44 | 15.8 | 229.6 | 117 | 6.33 |
| SELKIRK Invikta Power Air | 16.34 | 7.43 | 13 | 222.7 | 108 | 5.68 |
| SIXZERO Double Black Diamond 16 mm | 16.22 | 7.5 | 15.2 | 228.2 | 116 | 6.57 |

TABLE TWO

| Embodiment | Length (inches) | Width (inches) | Thickness (mm) | Weight (grams) | Swing Weight MOI (Kg * cm^2) | Twist Weight MOI (Kg * cm^2) |
|---|---|---|---|---|---|---|
| 1 | 16.32 | 7.77 | 15.86 | 237.2 | 121 | 6.77 |
| 2 | 16.33 | 7.65 | 15.48 | 232.5 | 115 | 6.97 |
| 3 | 16.33 | 7.64 | 15.38 | 234.8 | 110 | 6.94 |
| 4 | 16.31 | 7.68 | 15.58 | 229.7 | 116 | 7.04 |
| 5 | 16.32 | 7.65 | 15.35 | 235.7 | 109 | 6.89 |

Table Two is directed at pickleball paddles of present invention. Embodiment 1 has a TORAY T700 carbon fiber face. Each of embodiments 2, 3 and 5 has 12 grams of tungsten weighting.

Figure 17:
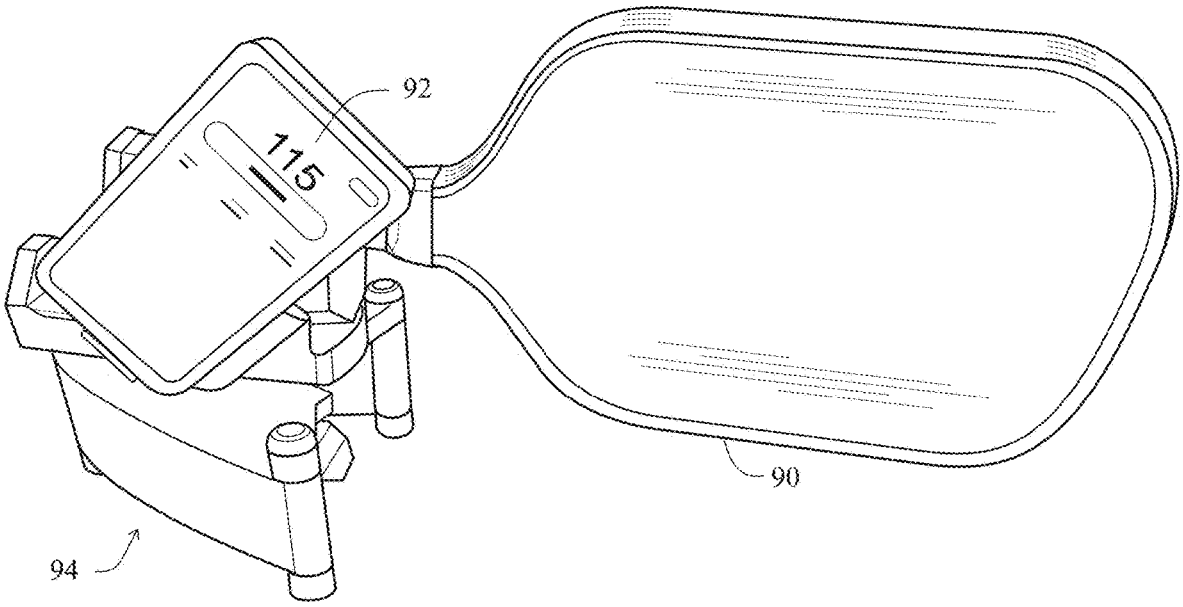
FIG. 17 is an illustration of testing a paddle for moment of inertia.

As shown in FIG. 17, the paddle 90 is placed in the swing weight/twist weight apparatus (BRIFFIDI SW1) 94 which works with a mobile app 92 on a mobile phone, and the grip is secured to a torsional pendulum of the apparatus 94. The apparatus 94 measures the oscillations of the paddle to determine a swing weight. The paddle oscillates about a neutral pivot point, approximately 2 inches from an end of the handle of the paddle. The apparatus is also used to measure MOI about the center of gravity. The apparatus is spring-driven and oscillates about a vertical axis to measure swingweight independent of mass and balance measurements. The companion mobile app 92 uses a gyroscope sensor in a mobile phone to measure the swingweight MOI and twist weight MOI with high precision.

One embodiment has four tungsten weights in a perimeter of the face of the paddle. The swing weight is 112-115, the twist weight is 7000 g-cm$^2$, the length is approximately 412 mm, the width is approximately 193 mm, and the core thickness is approximately 15.25 mm. Each of the four weights has a mass of approximately 3 grams.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A pickleball paddle comprising:

a body comprising a face section and a handle section, the face section having a perimeter;

a grip attached to the handle section;

a first visible weight member positioned in the perimeter of the face section and a second visible weight member positioned in the perimeter of the face section, wherein the first visible weight member and the second visible weight member each has a mass ranging from 2 to 10 grams, wherein the first visible weight member and the second visible weight member each has a thickness ranging from 5 mm to 15 mm, a length ranging from 3 to 7 cm, and a width ranging from 1 to 2 cm, wherein each of the first visible weight member and the second visible weight member is composed of tungsten material;

wherein the pickleball paddle has a moment of inertia greater than 6700 g-cm$^2$ about a Y-axis;

wherein the pickleball paddle has a length ranging from 15 to 17 inches and a width ranging from 7 inches to 8 inches.

2. The pickleball paddle according to claim 1 further comprising weighting in the handle section.

3. The pickleball paddle according to claim 1 wherein the body is composed of PEI with carbon fiber reinforcement.

4. The pickleball paddle according to claim 1 wherein the body is composed of PES with carbon fiber reinforcement.

5. The pickleball paddle according to claim 1 further comprising butt weights in the handle section.

6. The pickleball paddle according to claim 1 wherein the pickleball paddle has a moment of inertia greater than 6800 g-cm$^2$ about a Y-axis.

7. The pickleball paddle according to claim 1 wherein the pickleball paddle has a moment of inertia greater than 6900 g-cm$^2$ about a Y-axis.

8. The pickleball paddle according to claim 1 wherein the pickleball paddle has a moment of inertia greater than 7000 g-cm$^2$ about a Y-axis.

9. A pickleball paddle comprising:

a body comprising a face section and a handle section, the face section having a perimeter;

a grip attached to the handle section;

a first weighting member positioned in the perimeter of the face section on a first side, a second weighting member positioned in the perimeter of the face section on the first side, a third weighting member positioned in the perimeter of the face section on a second side, and a fourth weighting member positioned in the perimeter of the face section on the second side, wherein each of the first weight member, the second weight member, the third weight member and the fourth weight member is composed of a tungsten material and has a mass ranging from 2 to 5 grams, wherein each of the first weight member, the second weight member, the third weight member and the fourth weight member has a thickness ranging from 5 mm to 15 mm, a length ranging from 3 to 7 cm, and a width ranging from 1 to 2 cm, each of the first weight member, the second weight member, the third weight member and the fourth weight member is visible on the perimeter of the face section;

wherein the pickleball paddle has a moment of inertia greater than 7000 g-$cm^2$ about a Y-axis;

wherein the pickleball paddle has a length ranging from 15 to 17 inches and a width ranging from 7 inches to 8 inches.

* * * * *